US008079823B2

(12) United States Patent
Aynsley

(10) Patent No.: US 8,079,823 B2
(45) Date of Patent: Dec. 20, 2011

(54) FAN BLADES

(75) Inventor: Richard Michael Aynsley, Lexington, KY (US)

(73) Assignee: Delta T Corporation, Lexington, KY (US)

( * ) Notice: Subject to any disclaimer, the term of this patent is extended or adjusted under 35 U.S.C. 154(b) by 1064 days.

(21) Appl. No.: 11/858,360

(22) Filed: Sep. 20, 2007

(65) Prior Publication Data

US 2008/0008596 A1 Jan. 10, 2008

Related U.S. Application Data

(63) Continuation-in-part of application No. 11/046,593, filed on Jan. 28, 2005, now Pat. No. 7,284,960.

(60) Provisional application No. 60/589,945, filed on Jul. 21, 2004.

(51) Int. Cl.
*F04D 29/38* (2006.01)

(52) U.S. Cl. ..... 416/242; 416/243

(58) Field of Classification Search ..... 416/242, 416/223 R

See application file for complete search history.

(56) References Cited

U.S. PATENT DOCUMENTS

| | | | | |
|---|---|---|---|---|
| 1,938,799 | A * | 12/1933 | Bourne | 416/223 R |
| 2,157,999 | A * | 5/1939 | Charavay | 416/242 |
| 2,592,471 | A | 4/1952 | Sawyer | |
| 4,968,216 | A | 11/1990 | Anderson et al. | |
| 5,328,330 | A * | 7/1994 | Monroe | 416/62 |
| 5,492,448 | A * | 2/1996 | Perry et al. | 416/243 |
| 5,564,901 | A | 10/1996 | Moore | |
| 5,725,355 | A | 3/1998 | Crall et al. | |
| 5,823,480 | A | 10/1998 | La Roche | |
| 6,039,541 | A | 3/2000 | Parker et al. | |
| 6,161,797 | A | 12/2000 | Kirk et al. | |
| 6,244,821 | B1 * | 6/2001 | Boyd et al. | 416/223 R |
| 6,565,320 | B1 | 5/2003 | Surles et al. | |
| 6,719,533 | B2 | 4/2004 | Bird | |
| 6,884,034 | B1 | 4/2005 | Parker et al. | |
| 2003/0095864 | A1 | 5/2003 | Ivanovic | |
| 2006/0018751 | A1 | 1/2006 | Aynsley | |
| 2006/0018758 | A1 | 1/2006 | Aynsley | |

FOREIGN PATENT DOCUMENTS

| | | |
|---|---|---|
| CN | 2284082 Y | 6/1998 |
| DE | 3819145 | 12/1989 |
| EP | 0 096 255 | 12/1983 |
| GB | 100134 | 3/1917 |

(Continued)

OTHER PUBLICATIONS

JP 03-206394 A Machine Translation. Schreiber Translations, Inc. May 2011.*

(Continued)

*Primary Examiner* — Richard Edgar

(74) *Attorney, Agent, or Firm* — Frost Brown Todd LLC

(57) ABSTRACT

A fan blade comprises an airfoil having an upper surface with region that has a generally elliptical curvature. In some examples, the lower surface has a convex region and a concave region. The curvature of the concave region corresponds with the generally elliptical curvature of the upper surface; while the curvature of the convex region is defined by a substantially constant radius. Some examples also include a trailing edge flap region, which may itself include a first flap portion and a second flap portion. When mounted to a rotating hub member fan, blades with elliptical curvatures may provide air movement at significant efficiencies.

19 Claims, 10 Drawing Sheets

FOREIGN PATENT DOCUMENTS

| | | | |
|---|---|---|---|
| GB | 2050530 | | 1/1981 |
| JP | 03206394 | A * | 9/1991 |
| JP | 2002021777 | | 1/2002 |

OTHER PUBLICATIONS

International Search Report dated Nov. 3, 2009 for Application No. PCT/US08/73670.
Written Opinion dated Nov. 3, 2008 for Application No. PCT/US08/73670.
Fairbank et al.; A Large Paddle Fan for Livestock Cooling; Jun. 1989; Canadian Society of Agricultural Engineering.
Author Unknown; Dairy Notes; May 1999; University of California Cooperative Extension.
Author Unknown; A Fan for All Seasons; Dec. 1999; Bell & Howell Information and Learning, American Society of Mechanical Engineers; Mechanical Engineering vol. 121, No. 12, pp. 58-60.
Author Unknown; Technical Guide: Commercial Industrial & Special Application Ceiling Fans; publisher and date unknown.
Author Unknown; Airfoil Design: HVLS, dated Dec. 9, 2002.
Jain et al.; Experimental Investigation of the Flow Field of a Ceiling Fan; Jul. 2004; ASME Heat Transfer/Fluids Engineering Summer Conference; Paper No. HT-FED-2004-56226.
Screenshots from www.b737.org.uk, relating to winglets, printed May 2004.
Screenshots from oea.larc.nasa.gov, relating to winglets, printed May 2004.
Screenshots from Penn State Engineering website, relating to winglets, printed May 2004.
International Search Report, dated Aug. 19, 2005 for PCT Application No. PCT/US05/02703.
Written Opinion, dated Aug. 19, 2005 for PCT Application No. PCT/US05/02703.
EPO Search Report, dated Aug. 21, 2006 for EP 05250653.2.
EPO Search Report, dated Aug. 22, 2006 for EP 05250654.0.
Office Action dated Jan. 23, 2007 for U.S. Appl. No. 11/046,341, filed Jan. 28, 2005.
Office Action dated Jan. 25, 2007 for U.S. Appl. No. 11/046,593, filed Jan. 28, 2005.
Office Action dated May 14, 2007 for U.S. Appl. No. 11/046,593, filed Jan. 28, 2005.
EPO Search Report, dated Jul. 1, 2008, for EP 05 250 632.2, pp. 1-6.
EPO Search Report, dated Jul. 1, 2008, for EP 05 250 654.0, pp. 1-6.

* cited by examiner

FAN BLADES

PRIORITY

This application is a continuation-in-part of U.S. Non-Provisional patent application Ser. No. 11/046,593, entitled "Fan Blades," which is incorporated by reference herein, and which claims priority from the disclosure of U.S. Provisional Patent Application Ser. No. 60/589,945, entitled "Fan Blades and Modifications," filed Jul. 21, 2004, which is also incorporated by reference herein.

BACKGROUND

Some embodiments of the present invention relate generally to fan blades and fan blade modifications, and are particularly directed to an airfoil suitable for use with a fan blade and, optionally, a winglet suitable for use with a fan blade.

People who work in large structures such as warehouses and manufacturing plants may be exposed to working conditions that range from being uncomfortable to hazardous. The same may also apply in agricultural settings, such as in a structure that is full of livestock. On a hot day, the inside air temperature may reach a point where a person or other animal is unable to maintain a healthy or otherwise desirable body temperature. In areas where temperatures are uncomfortably or unsafely high, it may be desirable to have a device operable to create or enhance airflow within the area. Such airflow may, in part, facilitate a reduction in temperature in the area.

Moreover, some activities that occur in these environments, such as welding or operating internal combustion engines, may create airborne contaminants that can be deleterious to those exposed. The effects of airborne contaminants may be magnified if the air flow in the area is less than ideal. In these and similar situations, it may be desirable to have a device operable to create or enhance airflow within the area. Such airflow may, in part, facilitate the reduction of deleterious effects of contaminants, such as through dilution and/or removal of contaminants.

In certain structures and environments, a problem may arise with heat gathering and remaining near the ceiling of the structure. This may be of concern where the area near the floor of the structure is relatively cooler. Those of ordinary skill in the art will immediately recognize disadvantages that may arise from having this or other imbalanced air/temperature distribution. In these and similar situations, it may be desirable to have a device operable to create or enhance airflow within the area. Such airflow may, in part, facilitate de-stratification and the inducement of a more ideal air/temperature distribution.

It may also be desirable to have a fan capable of reducing energy consumption. Such a reduction of energy consumption may be effected by having a fan that runs efficiently (e.g., less power is required to drive the fan as compared to other fans). A reduction of energy consumption may also be effected by having a fan that improves air distribution, thereby reducing heating or cooling costs associated with other devices.

BRIEF DESCRIPTION OF THE DRAWINGS

The accompanying drawings incorporated in and forming a part of the specification illustrate several aspects of the present invention, and together with the description serve to explain the principles of the invention; it being understood, however, that this invention is not limited to the precise arrangements shown. In the drawings, like reference numerals refer to like elements in the several views. In the drawings.

Reference will now be made in detail to the present preferred embodiment of the invention, an example of which is illustrated in the accompanying drawings.

DETAILED DESCRIPTION

Figure 1:
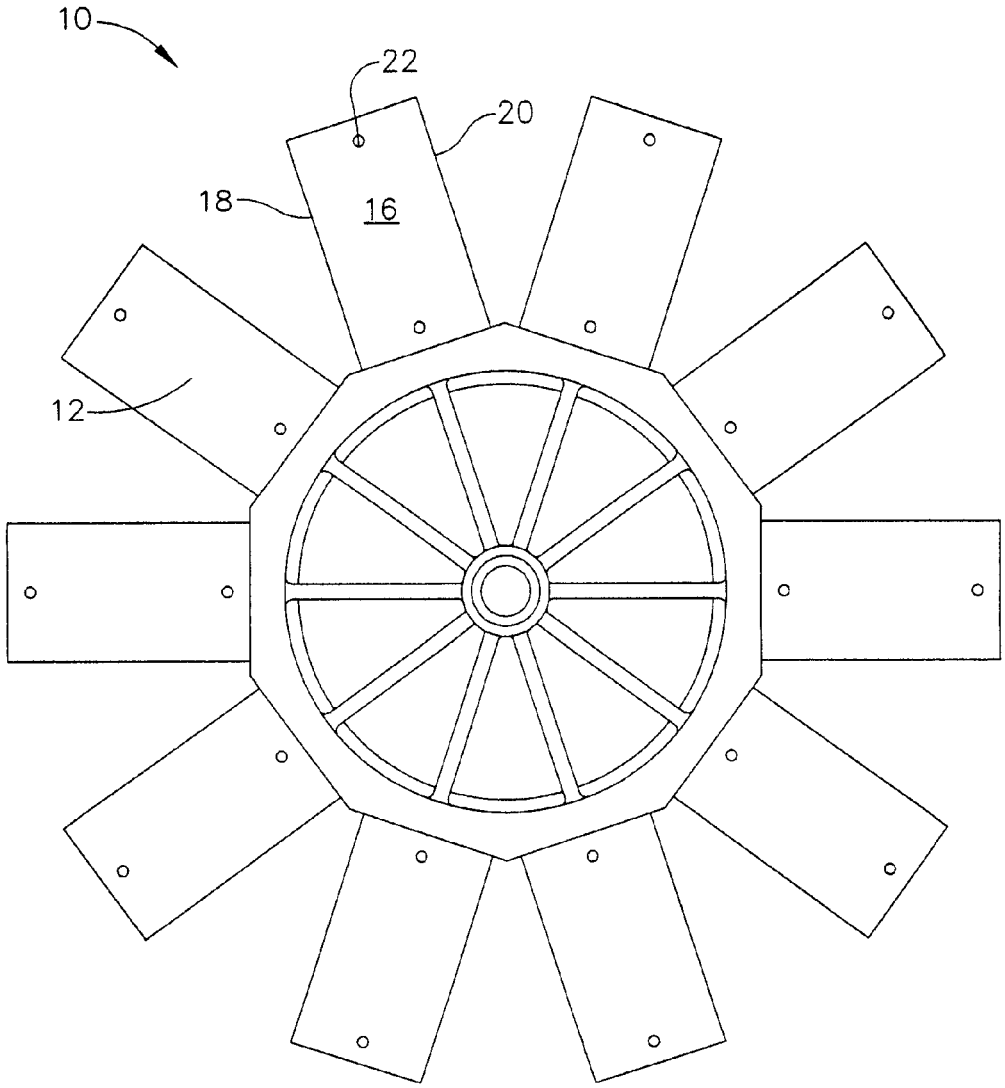
FIG. 1 is a plan view of a hub for mounting fan blades.

Referring now to the drawings in detail, wherein like numerals indicate the same elements throughout the views, FIG. 1 shows exemplary fan hub (10), which may be used to provide a fan having fan blades (30, 50, or 500). In the present example, fan hub (10) includes a plurality of hub mounting members (12) to which fan blades (30, 50, or 500) may be mounted. In one embodiment, fan hub (10) is coupled to a driving mechanism for rotating fan hub (10) at selectable or predetermined speeds. A suitable hub assembly may thus comprise hub (10) and a driving mechanism coupled to hub (10). Of course, a hub assembly may include a variety of other elements, including a different hub, and fan hub (10) may be driven by any suitable means. In addition, fan hub 10 may have any suitable number of hub mounting members (12).

Figure 2:
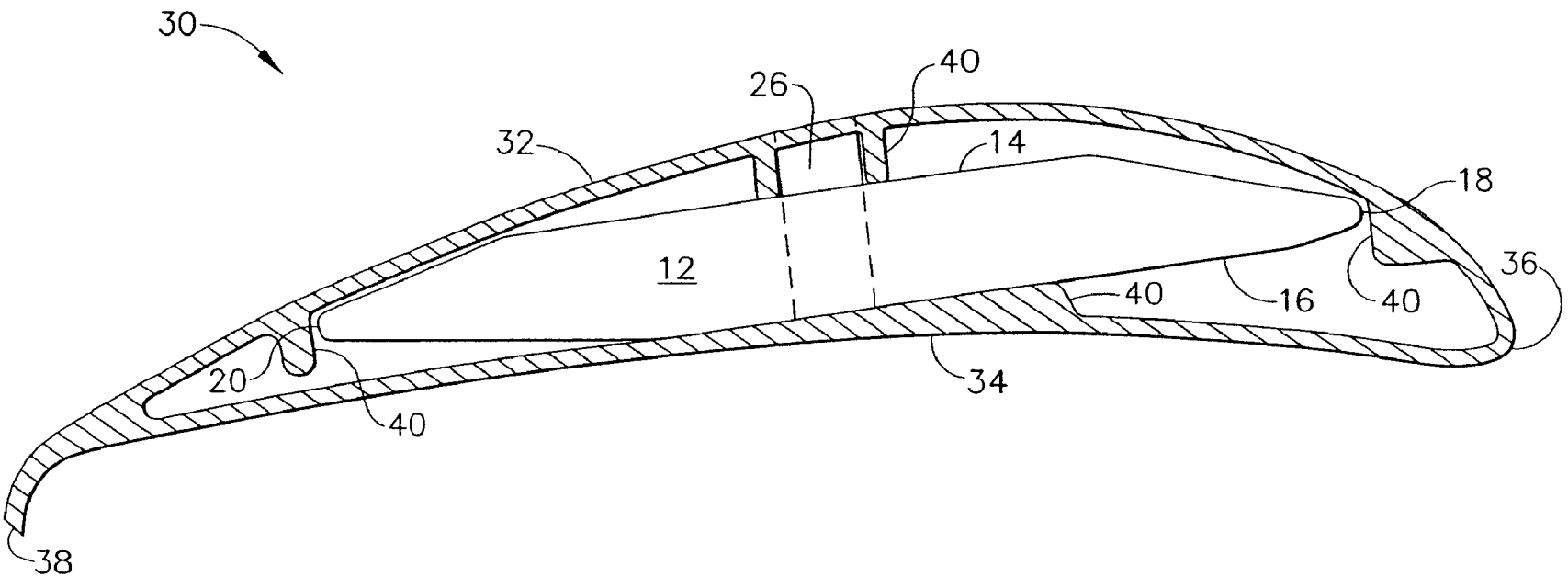
FIG. 2 is a cross-sectional view of an exemplary fan blade airfoil.
Figure 3:
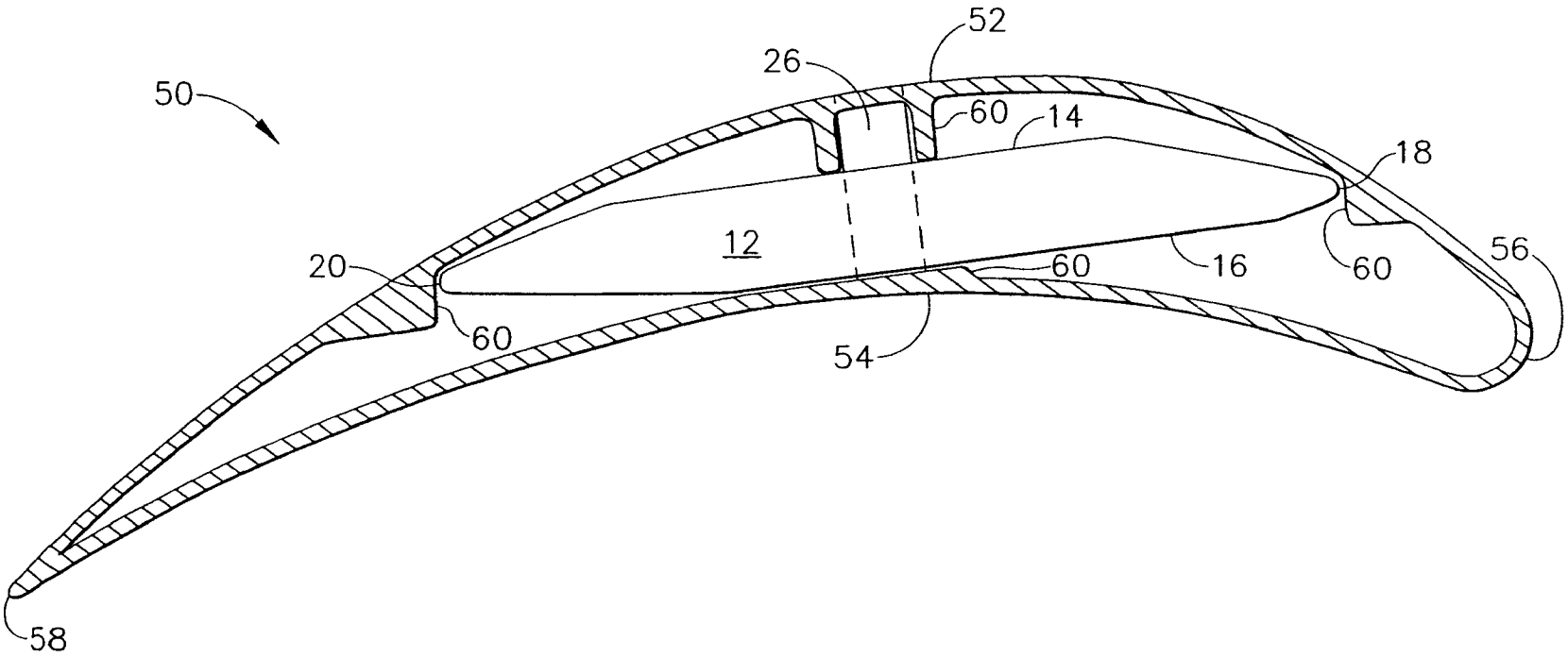
FIG. 3 is a cross-sectional view of an alternative exemplary fan blade airfoil.

As shown in FIGS. 1 through 3, each hub mounting member (12) has top surface (14) and bottom surface (16), which terminate into leading edge (18) and trailing edge (20). In addition, each hub mounting member (12) includes opening (22) formed through top surface (14) and going through bottom surface (16). In the present example, opening (22) is sized to receive fastener (26). Each hub mounting member (12) is configured to receive fan blade (30, 50, or 500). Those of ordinary skill in the art will appreciate, in view of the teachings herein, that hub mounting members (12) may be provided in a variety of alternative configurations.

In one embodiment, fan blades (30, 50, or 500) are mounted to the hub assembly disclosed in U.S. Pat. No. 6,244,821. Of course, fan blades (30, 50, or 500) may be mounted to any other hub and/or hub assembly. A suitable hub assembly may be operable to rotate hub (10) at any suitable angular speed. By way of example only, such angular speed may be anywhere in the range of approximately 7 and 108 revolutions per minute.

FIG. 2 shows a cross section of exemplary fan blade (30) having curled trailing edge (38), mounted to hub (10). The cross section is taken along a transverse plane located at the center of fan blade (30), looking toward hub (10). Fan blade (30) has top surface (32) and bottom surface (34), each of which terminate into leading edge (36) and trailing edge (38). As shown, trailing edge (38) has a slope of approximately 45° relative to portion of top surface (32) that is proximate to trailing edge (38) and portion of bottom surface (34) that is proximate to trailing edge (38). Of course, trailing edge (38) may have any other suitable slope, such as 0° by way of example only, to the extent that it comprises a single, flat surface. Other suitable trailing edge (38) configurations will be apparent to those of ordinary skill in the art in view of the teachings herein.

In the present example, fan blade (30) is substantially hollow. A plurality of ribs or bosses (40) are located inside fan blade (30). As shown, when hub mounting member (12) is inserted into fan blade (30), ribs or bosses (40) are positioned such that they contact top surface (14), bottom surface (16), leading edge (18), and trailing edge (20) of hub mounting member (12). Bosses (40) thus provide a snug fit between fan blade (30) and hub mounting member (12). Alternative configurations for fan blade (30), including but not limited to those affecting the relationship between fan blade (30) and hub mounting member (12), will be apparent to those of ordinary skill in the art in view of the teachings herein.

As used herein, terms such as "chord," "chord length," "maximum thickness," "maximum camber," "angle of attack," and the like, shall be ascribed the same meaning ascribed to those terms as used in the art of airplane wing or other airfoil design. In one embodiment, fan blade (30) has a chord length of approximately 6.44 inches. Fan blade (30) has a maximum thickness of approximately 16.2% of the chord; and a maximum camber of approximately 12.7% of the chord. The radius of leading edge (36) is approximately 3.9% of the chord. The radius of trailing edge (38) quadrant of bottom surface (34) is approximately 6.8% the chord. In an alternate embodiment, fan blade (30) has a chord of approximately 7 inches. In another embodiment, fan blade (30) has a chord of approximately 6.6875 inches. Of course, any other suitable dimensions and/or proportions may be used.

By way of example only, fan blade (30) may display lift to drag ratios ranging from approximately 39.8, under conditions where the Reynolds Number is approximately 120,000, to approximately 93.3, where the Reynolds Number is approximately 250,000. Of course, other lift to drag ratios may be obtained with fan blade (30).

In one embodiment, fan blade (30) displays drag coefficients ranging from approximately 0.027, under conditions where the Reynolds Number is approximately 75,000, to approximately 0.127, where the Reynolds Number is approximately 112,500. Of course, other drag coefficients may be obtained with fan blade (30).

In one example, under conditions where the Reynolds Number is approximately 200,000, fan blade (30) moves air such that there is a velocity ratio of approximately 1.6 at bottom surface (34) at trailing edge (38) of fan blade (30). Other velocity ratios may be obtained with fan blade (30).

In one embodiment, fan blade (30) provides non-stall aerodynamics for angles of attack between approximately −1° to 7°, under conditions where the Reynolds Number is approximately 112,000; and angles of attack between approximately −2° to 10°, where the Reynolds number is approximately 250,000. Of course, these values are merely exemplary.

FIG. 3 shows a cross section of another exemplary fan blade (50) having generally elliptical top surface (52) and bottom surface (54), each of which terminate in leading edge (56) and trailing edge (58), mounted to hub (10). The cross section is taken along a transverse plane located at the center of fan blade (50), looking toward hub (10). In the present example, fan blade (50) is hollow. A plurality of bosses (60) are located inside fan blade (50). As shown, when hub mounting member (12) is inserted into fan blade (50), bosses (60) are positioned such that they contact top surface (14), bottom surface (16), leading edge (18), and trailing edge (20) of hub mounting member (12). Bosses (60) thus provide a snug fit between fan blade (50) and hub mounting member (12). Alternative configurations for fan blade (50), including but not limited to those affecting the relationship between fan blade (50) and hub mounting member (12), will be apparent to those of ordinary skill in the art in view of the teachings herein.

As shown, fan blade (50) has a lower radius of curvature toward its leading edge (56), as compared to a higher radius of curvature toward its trailing edge (58). The curvatures of fan blade (50) may be obtained, at least in part, through the generation of two ellipses using the following formulae. In view of the teachings herein, those of ordinary skill in the art will appreciate that a first ellipse, with its origin at the intersection of Cartesian x and y axes, may be generated by these equations:

$$x=a(\mathrm{COS}(t)),\ \text{and} \qquad [1]$$

$$y=b(\mathrm{SIN}(t)), \qquad [2]$$

where a=length of primary radius, b=length of secondary radius, and t=angle of rotation of a radius about the origin (e.g., in radians).

Accordingly, a first ellipse may be generated using the foregoing equations. Similarly, a set of coordinates for the first ellipse may be obtained using equations [1] and [2]. Exemplary first ellipse (200) is illustrated in the graph depicted in FIG. 4, where a=3 and b=2.

Coordinates for a second ellipse may be obtained using these equations:

$$x_2=x(\mathrm{COS}(\theta))-y(\mathrm{SIN}(\theta)),\ \text{and} \qquad [3]$$

$$y_2=y(\mathrm{COS}(\theta))-x(\mathrm{SIN}(\theta)), \qquad [4]$$

where $x_2$=the second "x" coordinate after a counterclockwise rotation of the first ellipse through θ radians about the origin, and $y_2$=the second "y" coordinate after a counterclockwise rotation of the first ellipse through θ radians about the origin.

Figure 4:
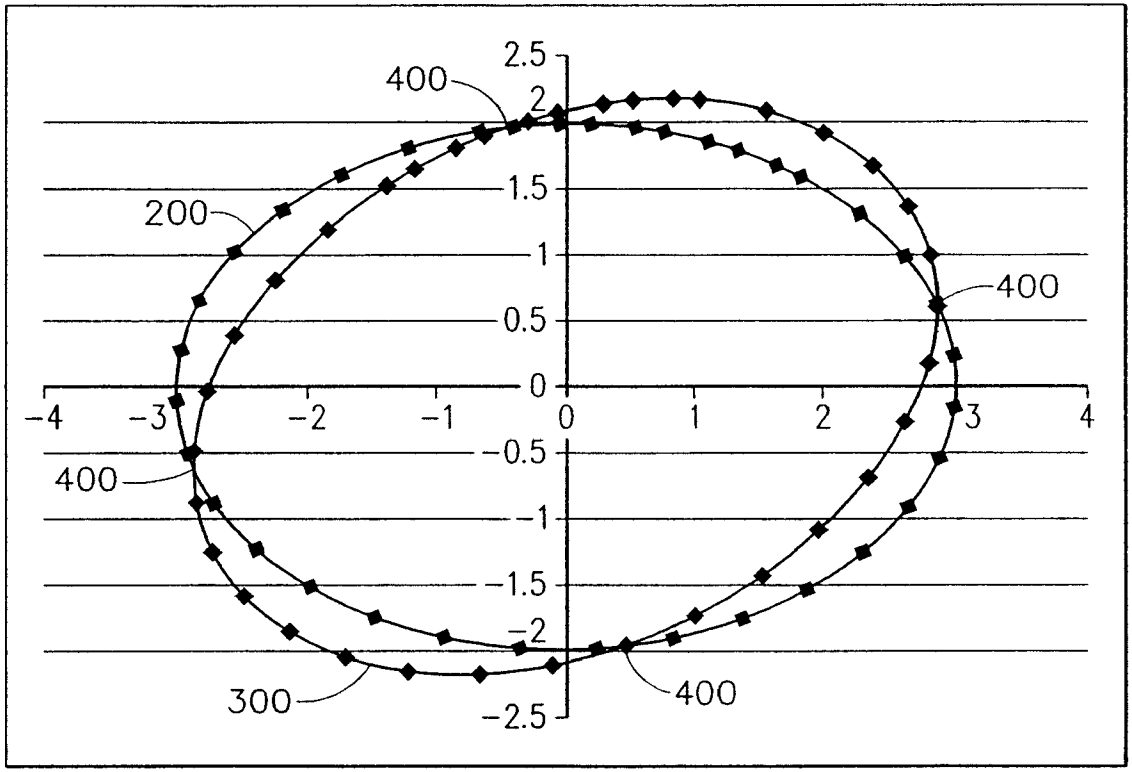
FIG. 4 depicts a graph showing two ellipses.

Thus, the dimensions of the second ellipse are dependent on the dimensions of the first ellipse. Exemplary second ellipse (300) is illustrated in the graph depicted in FIG. 4, where θ=0.525 radians. It will be appreciated that, where a first and second ellipse are plotted in accordance with equations [1] through [4], the two ellipses may intersect at four points ("ellipse intersections"). FIG. 4 shows four ellipse intersections (400) between first ellipse (200) and second ellipse (300).

Figure 5:
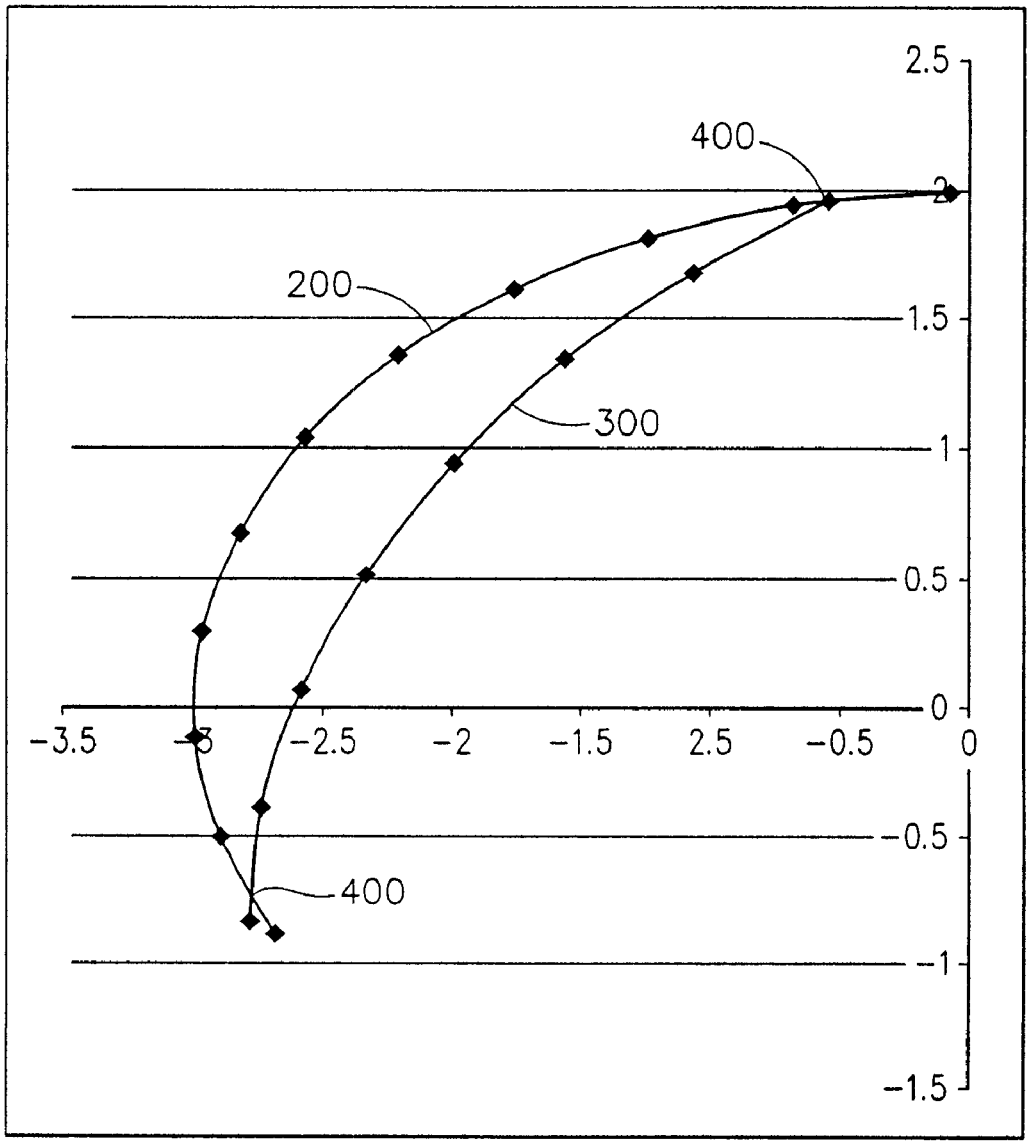
FIG. 5 depicts a portion of the graph of FIG. 4.
Figure 7:
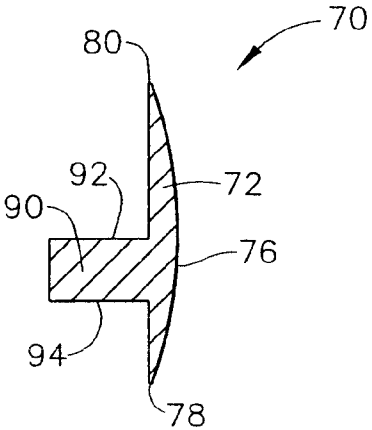
FIG. 7 is a cross-sectional view of the winglet of FIG. 6.
Figure 6:
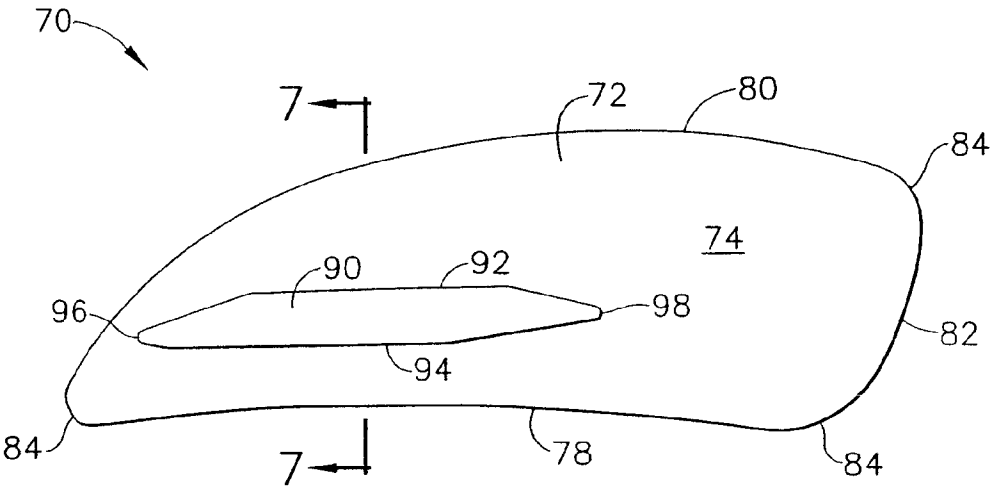
FIG. 6 is side view of an exemplary winglet fan blade modification
Figure 8:
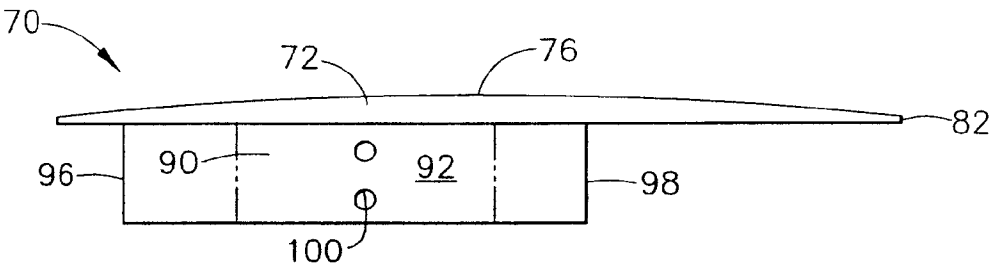
FIG. 8 is a top view of the winglet of FIG. 6.

The curvature of top surface (52) and bottom surface (54) may be based, at least in part, on the curvature of the first and second ellipses between two consecutive ellipse intersections. An example of such a segment of first ellipse (200) and second ellipse (300) is shown in FIG. 5, which depicts the portion of ellipses (200 and 300) between consecutive ellipse intersections (400). Accordingly, equations [1] through [4] may be used to generate surface coordinates for at least a portion of top surface (52) and bottom surface (54) of fan blade (50).

It will be appreciated that the chord length-to-thickness ratio of fan blade (50) may vary with the amount of rotation, θ, relative the two ellipses.

Of course, portions of fan blade (50) may deviate from the curvature of the first and second ellipses. By way of example only, and as shown in FIG. 3, leading edge (56) may be modified to have a generally circular curvature. Other deviations will be apparent to those of ordinary skill in the art in view of the teachings herein.

In one embodiment, fan blade (50) is created using equations [1] through [4] with a=3 units, b=2 units, and θ=0.525 radians. In this embodiment, fan blade (50) is fit with circular leading edge (56) having a diameter of 3.5% of chord length. This leading (56) edge curvature is fit tangentially to that of top surface (52) and bottom surface (54). Such a fit may be envisioned by comparing FIGS. 3 and 5. Of course, other dimensions may be used.

In one embodiment, fan blade (50) has a chord length of approximately 7.67 inches. In another embodiment, fan blade has a chord length of approximately 7.687 inches. Of course, fan blade (50) may have any other suitable chord length.

In the present example, the radius of leading edge (56) is approximately 3.5% of the chord. The maximum thickness of fan blade (50) is approximately 14.2% of the chord. The maximum camber of fan blade (50) is approximately 15.6% of the chord. Of course, any other suitable dimensions and/or proportions may be used.

In one example, a fan having a 24-foot diameter and comprising ten fan blades (50) mounted at an angle of attack of 10° produces a thrust force of approximately 5.2 lb. when rotating at approximately 7 revolutions per minute (rpm), displacing approximately 87,302 cubic feet per minute (cfm). When rotating at approximately 14 rpm, the fan produces a thrust force of approximately 10.52 lb., displacing approximately 124,174 cfm. When rotating at approximately 42 rpm, the fan produces a thrust force of approximately 71.01 lb., displacing approximately 322,613 cfm. Other thrust forces and/or displacement volumes may be obtained with a fan having fan blades (50).

By way of example only, fan blade (50) having an angle of attack of approximately 10° may display lift to drag ratios ranging from approximately 39, under conditions where the Reynolds Number is approximately 120,000, to approximately 60, where the Reynolds Number is approximately 250,000. Other lift to drag ratios may be obtained with fan blade (50).

In one embodiment, fan blade (50) provides non-stall aerodynamics for angles of attack between approximately 1° to 11°, under conditions where the Reynolds Number is approximately 112,000; for angles of attack between approximately 0° and 13°, where the Reynolds number is approximately 200,000; and for angles of attack between approximately 1° to 13°, where the Reynolds number is approximately 250,000. Of course, these values are merely exemplary.

In one example, a fan having a 14-foot diameter and comprising ten fan blades (50) is rotated at approximately 25 rpm. The fan runs at approximately 54 watts, with a torque of approximately 78.80 inch-pounds (in.lbs.) and a flow rate of approximately 34,169 cfm. The fan thus has an efficiency of approximately 632.76 cfm/Watt.

In another example, a fan having a 14-foot diameter and comprising ten fan blades (50) is rotated at approximately 37.5 rpm. The fan runs at approximately 82 watts, with a torque of approximately 187.53 inch-pounds (in.lbs.) and a flow rate of approximately 62,421 cfm. The fan thus has an efficiency of approximately 761.23 cfm/Watt.

In yet another example, a fan having a 14-foot diameter and comprising ten fan blades (50) is rotated at approximately 50 rpm. The fan runs at approximately 263 watts, with a torque of approximately 376.59 inch-pounds (in.lbs.) and a flow rate of approximately 96,816 cfm. The fan thus has an efficiency of approximately 368.12 cfm/Watt.

Figure 11:
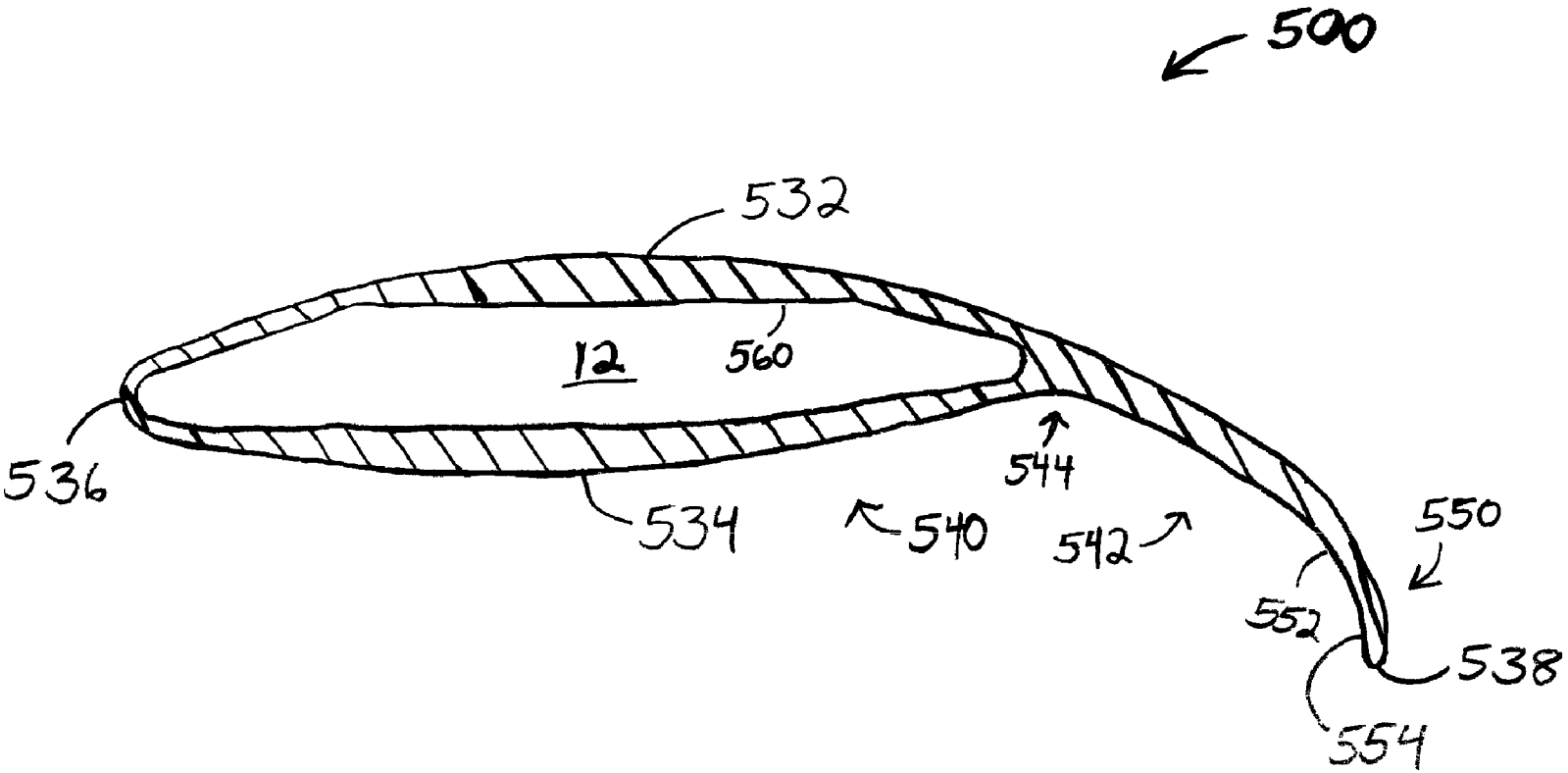
FIG. 11 is a cross-sectional view of another alternative exemplary fan blade airfoil.
Figure 12:
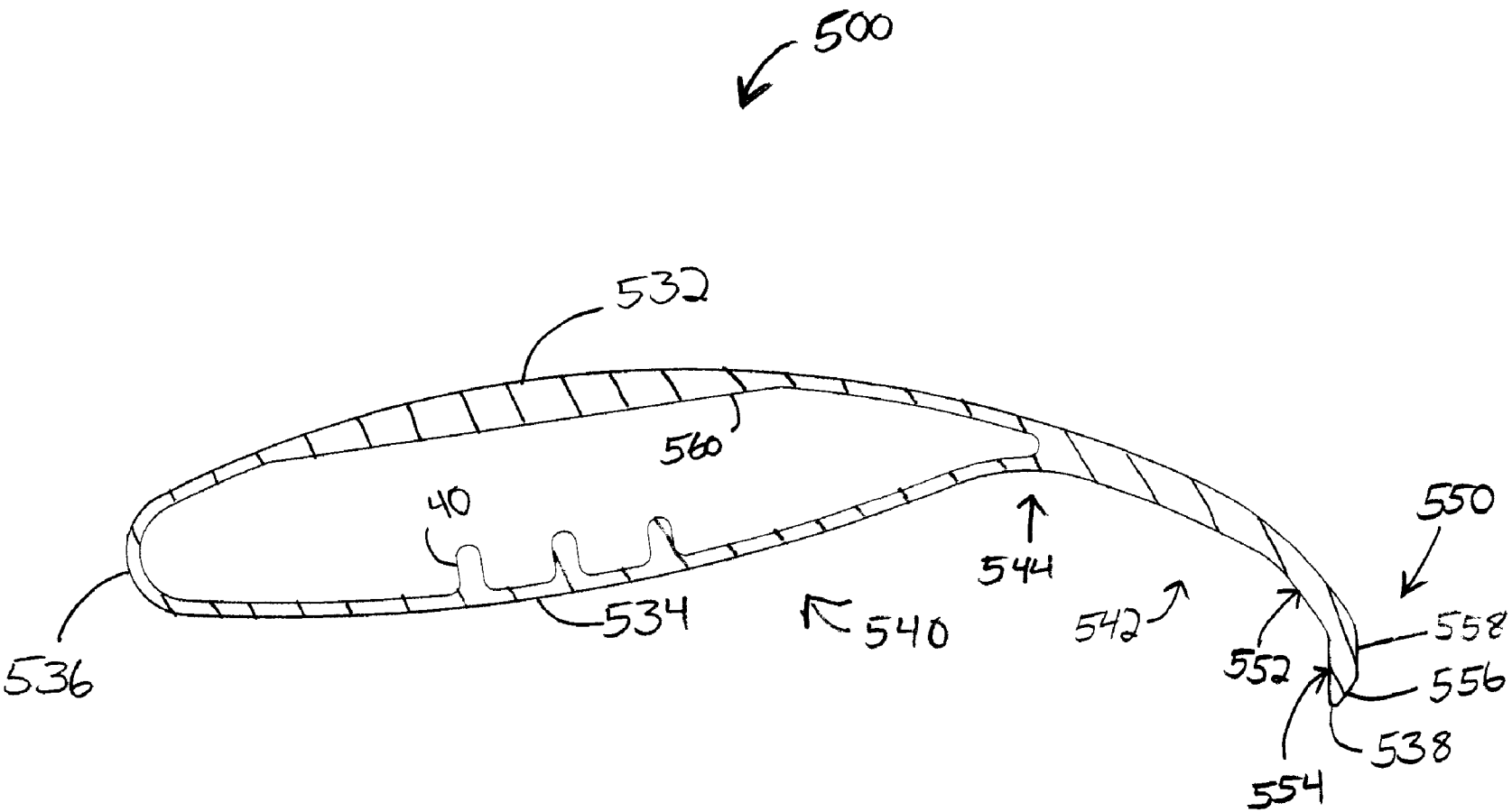
FIG. 12 is a cross-sectional view of an exemplary variation of the fan blade airfoil of FIG. 11.

Yet another merely exemplary fan blade (500) is shown in FIG. 11, with an additional variation of fan blade (500) being shown in FIG. 12. In this example, fan blade (500) has an upper surface (532) and a lower surface (534), each of which terminate into a leading edge (536) and a trailing edge (538). Leading edge (536) of the present example has a radius of curvature of approximately 0.313 inches, though any other suitable radius of curvature may be used. For instance, leading edge (536) may have a radius of curvature ranging from approximately 0.3 inches, inclusive, to approximately 0.40 inches, inclusive; from approximately 0.25 inches, inclusive, to approximately 0.45 inches, inclusive; from approximately 0.20 inches, inclusive, to approximately 0.50 inches, inclusive; from approximately 0.15 inches, inclusive, to approximately 0.55 inches, inclusive; from approximately 0.10 inches, inclusive, to approximately 0.60 inches, inclusive; or within any other suitable range.

A trailing edge flap region (550) is provided adjacent to trailing edge (538) in the present example. Variations and exemplary configurations for trailing edge flap region (550) will be described in greater detail below. However, like other components described herein, trailing edge flap region (550) is optional, and may be varied, substituted, supplemented, or omitted as desired.

Fan blade (500) of this particular example is substantially hollow; and unlike fan blades (30 and 50), fan blade (500) lacks bosses (40 or 60) within its interior. In other words, the interior that is defined by the interior wall (560) of fan blade (500) is configured to receive hub mounting member (12), such that hub mounting member (12) abuts interior wall (560). Such a fit between fan blade (500) and hub mounting member (12) may be an interference fit, may be loose, or may have other properties. Furthermore, it will be appreciated that other versions of fan blade (500) may have bosses (40 or 60) or other structures within the interior defined by interior wall (560). One merely illustrative example of a fan blade (500) that has bosses (40) is shown in FIG. 12. Still other ways in which a fan blade (500) may engage with a hub mounting member (12) or any other component of a fan hub (10) will be apparent to those of ordinary skill in the art in view of the teachings herein.

In the present example, upper surface (532) has a generally elliptical curvature. For instance, the curvature of upper surface (532) may be based at least in part on equations [1] and [2], provided above. By way of example only, a set of coordinates corresponding with and defining the curvature of a portion of upper surface (532) may be provided where a=6.019 inches and b=2.55 inches in equations [1] and [2]. Of course, any other values may be used for "a" and/or "b." For instance, the value for "a" may be any suitable value between approximately 6.0 inches, inclusive, to approximately 6.1 inches, inclusive; from approximately 5.9 inches, inclusive, to approximately 6.2 inches, inclusive; from approximately 5.8 inches, inclusive, to approximately 6.3 inches, inclusive; from approximately 5.0 inches, inclusive, to approximately 7.0 inches, inclusive; from approximately 4.0 inches, inclusive, to approximately 8.0 inches, inclusive; from approximately 3.0 inches, inclusive, to approximately 9.0 inches, inclusive; from approximately 2.0 inches to approximately 10.0 inches, inclusive; from approximately 1.0 inches and approximately 11.0 inches, or within any other suitable range. Similarly, the value for "b" may be any suitable value between approximately 2.5 inches, inclusive, to approximately 2.6 inches, inclusive; from approximately 2.4 inches, inclusive, to approximately 2.7 inches, inclusive; from approximately 2.3 inches, inclusive, to approximately 2.8 inches, inclusive; from approximately 2.2 inches, inclusive, to approximately 2.9 inches, inclusive; from approximately 2.0 inches, inclusive, to approximately 3.0 inches, inclusive; from approximately 1.0 inches, inclusive, to approximately 4.0 inches, inclusive; from approximately 0.5 inches, inclusive to approximately 5.0 inches; or within any other suitable range.

As is shown in FIG. 11, the configuration of upper surface (532) deviates from the above-noted elliptical curvature in the part of upper surface (532) corresponding with trailing edge flap region (550). In particular, and by way of example only, upper surface (532) generally drops downward at trailing edge flap region (550), without continuing along the elliptical curvature noted above.

In other embodiments, upper surface (532) may continue with an elliptical curvature all the way to trailing edge (538) or may have any other suitable configuration as the upper surface (532) approaches trailing edge (538). Alternatively, upper surface (532) may extend all the way to the trailing edge flap region (550), such that trailing edge flap region (550) provides a surface that is different from upper surface (532). Of course, to the extent that a trailing edge flap region (550) is even provided, it need not be provided in the particular manner shown and described herein.

As shown in FIG. 11, lower surface (534) of fan blade (500) of the present example has a convex region (540) and a concave region (542). Convex region (540) terminates at leading edge (536); while concave region (542) terminates at trailing edge (538). A transition area (544) provides a generally smooth transition from convex region (540) to concave region (542). Transition area (544) of the present example has a radius of curvature of approximately 0.781 inches, though any other suitable radius of curvature may be used. For instance, the radius of curvature for transition area (544) may be anywhere between approximately 0.5 inches, inclusive, and approximately 1.0 inches, inclusive; between approximately 0.25 inches, inclusive, and approximately 1.25 inches, inclusive; between approximately 0.1 inches, inclusive, and approximately 2.0 inches, inclusive; or of any other suitable radius within any other range of values. Of course, a transition from a convex region (540) to a concave region (542) may be provided in any other suitable fashion (e.g., a drastic or sharp transition, a substantially flat area between convex region (540) and concave region (542), etc.).

Even though upper surface (532) of the present example drops downward at trailing edge flap region (550), deviating from the above-noted elliptical curvature defined by most of upper surface (532), the upper surface does not drop downward and so deviate directly above transition area (544) of lower surface (534). In particular, the curvature of upper surface (532) changes at a location along the width of fan blade (500) that is different from the location along the width of fan blade (500) at which the curvature of lower surface (534) changes. That is, in the present example, the curvature of upper surface (532) changes at a location that is closer to trailing edge (538) than the location at which the curvature of lower surface (534) changes. In other embodiments, however, the curvature of upper surface (532) may change at approximately the same location along the width of fan blade (500) as the curvature of lower surface (534). In still other embodiments, the curvature of lower surface (534) may change at a location that is closer to trailing edge (538) than the location at which the curvature of upper surface (532) changes. Still other suitable relationships between any changes in curvature of upper surface (532) and lower surface (534) will be apparent to those of ordinary skill in the art in view of the teachings herein, to the extent that such curvatures change at all along the width of fan blade (500).

In the present example, convex region (540) of lower surface (534) has a circular curvature defined by a radius of approximately 9.29 inches, though any other suitable radius of curvature may be used. For instance, a radius defining curvature of convex region (540) may be anywhere between approximately 9 inches, inclusive, and approximately 10 inches, inclusive; between approximately 8 inches, inclusive, and approximately 11 inches, inclusive; approximately 6 inches, inclusive, and approximately 13 inches, inclusive; approximately 2 inches, inclusive, and approximately 20 inches, inclusive; or any other suitable radius within any other range of values.

In an alternative embodiment (not depicted), at least a portion of lower surface (534) in the present example may have a generally elliptical curvature similar to upper surface (532). For instance, the curvature of convex region (540) may be based at least in part on equations [1] and [2], provided above. By way of example only, a set of coordinates corresponding with and defining the curvature of convex region (540) may be provided with any suitable values for "a" and/or "b" in equations [1] and [2]. It also will be appreciated, that, to the extent that the curvature of convex region (540) and the curvature of upper surface (532) are based at least in part on equations [1] and [2], it may be desirable in some situations to provide differences between such curvatures by using different values within equations [1] and [2]. For instance, the values for "a" and/or "b" may be greater when used to provide a curvature for upper surface (532) in accordance with equations [1] and [2] than the values for "a" and/or "b" when used to provide a curvature for convex region (540) of lower surface (534) in accordance with equations [1] and [2]. In other embodiments, one or both of "a" and/or "b" may have the same value when used in equations [1] and [2] to define the curvature of upper surface (532) and convex region (540) of lower surface (540). Of course, any other suitable values for "a" and "b" may be used, regardless of the surface (532 or 534) concerned; and the values for "a" and "b" as used relative to the upper surface (532) may have any suitable relationship with the values for "a" and "b" as used relative to convex region (540) of lower surface (540). For instance, with the values for "a" and "b" as used relative to convex region (540) of lower surface (540) may be proportional to the values for "a" and "b" as used relative to the upper surface (532). Other suitable relationships between such values, to the extent that any relationships between such values are even used, will be apparent to those of ordinary skill in the art in view of the teachings herein.

In the present example, the configuration of concave region (542) of lower surface (534) is configured to correspond with or mimic the configuration of upper surface (532). In particular, and by way of example only, concave region (542) of lower surface (534) is substantially parallel with the complimentary region of upper surface (532). In other words, the curvature of concave region (542) may be based at least in part on the same formula used to provide the curvature of upper surface (532), including the same or similar values for "a" and/or "b" within equations [1] and [2]. In addition, concave region (542) may "drop off" or drop downward at trailing edge flap region (550) to the same or similar degree as the drop off or drop down of upper surface (532) at trailing edge flap region (550). Thus, in the present example, the portion of fan blade (500) that is between transition area (544) and trailing edge (538) has a substantially uniform thickness. Other ways in which concave region (542) of lower surface (534) may correspond with or generally mimic the configuration of upper surface (532) will be apparent to those of ordinary skill in the art in view of the teachings herein. Of course, concave region (542) of lower surface (534) may have any other suitable configuration.

In the present example, trailing edge flap region (550) comprises a first flap portion (552) and a second flap portion (554). First flap portion (552) is set at an angle of approximately 25° from the lower surface (534); while second flap portion (554) is set at an angle of approximately 35° from the first flap portion (552) (such that second flap portion (554) is set at an angle of approximately 60° from the portion of lower surface (534) that is adjacent to first flap portion (552)). By way of example only, second flap portion (554) may be configured such that it is oriented approximately vertically (e.g., approximately 90° relative to the ceiling and/or flat ground) when fan blade (500) is mounted to a hub (10). Other suitable angles may be used. By way of example only, first flap portion (552) may be set at an angle from lower surface (534) that is anywhere between approximately 20°, inclusive, and approximately 30°, inclusive; between approximately 15°, inclusive, and approximately 35°, inclusive; between approximately 10°, inclusive, and approximately 40°, inclusive; or at any other suitable angle. Of course, second flap portion (554) may also be set at an angle from first flap portion (552) that is within any of those ranges, among others. Similarly, second flap portion (554) may be set at an angle from first flap portion (552) that is anywhere between approximately 55°, inclusive, and approximately 65°, inclusive; between approximately 50°, inclusive, and approximately 70°, inclusive; between approximately 45°, inclusive, and approximately 75°, inclusive; or at any other suitable angle. Of course, first flap portion (552) may also be set at an angle from lower surface (534) that is within any of those ranges, among others.

It will be appreciated that first flap portion (552) and second flap portion (554) may begin and end at any suitable locations along lower surface (534) of fan blade (500). By way of example only, where the chord of fan blade (500) is approximately 6.27 inches, first flap portion (552) may begin at approximately 6.875 inches, measured from leading edge (536) along lower surface (534), and may extend for approximately 0.438 inches along lower surface (534). Second flap portion (554) may begin where first flap portion (552) ends, and may extend approximately 0.375 inches along lower surface (534) to reach trailing edge (538).

Of course, any other suitable locations for the beginning and ending of first flap portion (552) and second flap portion (554) may be used; and first and second flap portions (552, 554) may each extend for any suitable length. In addition, fan blade (500) may have any other suitable chord. For instance, first flap portion (552) may begin anywhere along lower surface (534) between approximately 6 inches, inclusive, and approximately 7 inches, inclusive; between approximately 5 inches, inclusive, and approximately 8 inches, inclusive; between approximately 4 inches, inclusive, and approximately 9 inches, inclusive; between approximately 3 inches, inclusive, and approximately 9 inches, inclusive; or at any other suitable location along lower surface (534). Similarly, second flap portion (554) may begin anywhere along lower surface (534) between approximately 7 inches, inclusive, and approximately 8 inches, inclusive; between approximately 6 inches, inclusive, and approximately 9 inches, inclusive; between approximately 5 inches, inclusive, and approximately 10 inches, inclusive; between approximately 4 inches, inclusive, and approximately 11 inches, inclusive; or at any other suitable location along lower surface (534). It will also be appreciated that fan blade (500) may have any other suitable chord. By way of example only, fan blade (500) may have a chord that is anywhere between approximately 6 inches and approximately 7 inches; between approximately 5 inches and approximately 8 inches; between approximately 4 inches and approximately 9 inches; between approximately 3 inches and approximately 10 inches; or any other suitable chord.

As shown in FIG. 12, some embodiments of trailing edge flap region (550) may include a first flat region (556) that is located along upper surface (532) and a second flat region (558) that is located along upper surface (532). By way of example only, first flat region (556) may define an angle with the lower surface of second flap portion (554) that is approximately 35°. Other suitable angles may include any of those between and including approximately 30° and approximately 40°; between and including approximately 25° and approximately 45°; between and including approximately 20° and approximately 50°; between and including approximately 15° and approximately 55°; or any other angle within any other suitable range. Second flat region (558) along upper surface (532) may be approximately parallel with the lower surface of second flap portion (554). For instance, second flat region (558) may be configured such that it is oriented approximately vertically (e.g., approximately 90° relative to the ceiling and/or flat ground) when fan blade (500) is mounted to a hub (10). Of course, any other suitable angles or configurations may be used.

In some embodiments, the lower and/or upper surface of first flap portion (552) and/or second flap portion (554) are/is substantially flat, such as is shown in FIG. 12. In some other embodiments, the lower and/or upper surface of first flap portion (552) and/or second flap portion (554) are/is generally rounded, such as is shown in FIG. 11. Still other ways in which lower surface and upper surface of first flap portion (552) and/or second flap portion (554) may be configured will be apparent to those of ordinary skill in the art in view of the teachings herein.

In the present example, first flap portion (552) and second flap portion (554) are integrally formed with the rest of fan blade (500). For instance, fan blade (500) may be formed as a unitary extrusion (e.g., extruded aluminum, etc.), including first flap portion (552) and second flap portion (554). In other embodiments, first flap portion (552) and/or second flap portion (554) are formed separate from the remainder of fan blade (500), and are secured thereto using fasteners, welding, or other structures or techniques. It will also be appreciated that first flap portion (552) or second flap portion (554) may be omitted from trailing edge flap region (550); or that trailing edge flap region may be otherwise configured or even omitted altogether.

In some embodiments, trailing edge flap region (550) is configured to create a pocket of high pressure air under the rear portion of fan blade (500) when a fan having a plurality of fan blades (500) is rotating. Of course, other results may be obtained with the exemplary configuration of trailing edge flap region (550), in addition to or in lieu of the high pressure pocket mentioned above. Alternatively, the high pressure pocket may not be created by trailing edge flap region (550) as described herein, even if in the exemplary configuration, or if in other configurations.

As a merely prophetic example, the following table illustrates efficiencies that may be obtained using fan blades (500), mounted with an 8° angle of attack on a fan having a 24 foot diameter:

TABLE 1

| 24-foot Fan With Fan Blades (500) | | | | | |
|---|---|---|---|---|---|
| Speed (rpm) | Max. Power (watt) | Avg. Power (watt) | Torque (in · lbs) | Flowrate (cfm) | Efficiency (cfm/watt) |
| 9.3 | 70 | 70 | 123.4 | 62,886 | 898.4 |
| 13.7 | 110 | 100 | 252.9 | 88,136 | 991.4 |
| 18.22 | 170 | 160 | 441.5 | 123,505 | 771.9 |
| 22.62 | 280 | 270 | 646.7 | 157,214 | 582.3 |
| 27.02 | 420 | 410 | 934.0 | 191,997 | 468.3 |
| 31.67 | 660 | 650 | 1,365.0 | 231,057 | 355.5 |
| 35.69 | 870 | 860 | 1,681.4 | 254,612 | 296.1 |
| 40.72 | 1,300 | 1,210 | 2,115.1 | 282,236 | 233.3 |
| 45.11 | 1,640 | 1,580 | 2,644.7 | 312,627 | 197.9 |
| 49.89 | 2,220 | 2,110 | 3,068.2 | 355,338 | 167.4 |
| 54.04 | 2,820 | 2,640 | 3,573.5 | 367,838 | 139.3 |

Of course, other results may be obtained with a 24-foot fan with fan blades (500).

As another merely prophetic example, the following table illustrates efficiencies that may be obtained using fan blades (500), mounted with an 8° angle of attack on a fan having a 6 foot diameter:

TABLE 2

| 6-foot Fan With Fan Blades (500) | | | | |
|---|---|---|---|---|
| Speed (rpm) | Avg. Power (watt) | Torque (in · lbs) | Flowrate (cfm) | Efficiency (cfm/watt) |
| 27.7 | 21 | 3.4 | 3,439 | 163.8 |
| 41.5 | 51 | 7.8 | 5,742 | 112.6 |
| 55.3 | 72 | 13.8 | 7893 | 109.6 |
| 69.2 | 81 | 22.2 | 11,112 | 137.2 |
| 83 | 120 | 33.4 | 13,377 | 111.5 |
| 96.8 | 162 | 47.2 | 16,581 | 102.4 |
| 110.7 | 210 | 65.8 | 20,090 | 95.7 |
| 124.5 | 270 | 73.6 | 20,960 | 77.6 |
| 138.3 | 320 | 100.6 | 24,216 | 75.7 |
| 152.2 | 430 | 107.8 | 25,887 | 60.2 |
| 166 | 520 | 130.3 | 28,239 | 54.3 |

Of course, other results may be obtained with a 6-foot fan with fan blades (500).

The following may be applied to any fan blade, including by way of example only, fan blade (30), fan blade (50), or fan blade (500):

In one embodiment, each fan blade (30, 50, 500) comprises a homogenous continuum of material. By way of example only, fan blades (30, 50, and 500) may be constructed of extruded aluminum. However, it will be appreciated that fan blades (30, 50, and/or 500) may be constructed of any other suitable material or materials, including but not limited to any metal and/or plastic. In addition, it will be appreciated that fan blades (30, 50, and/or 500) may be made by any suitable method of manufacture, including but not limited to stamping, bending, welding, and/or molding. Other suitable materials and methods of manufacture will be apparent to those of ordinary skill in the art in view of the teachings herein.

When fan blade (30, 50, or 500) is mounted to hub (10), hub mounting members (12) may extend into fan blade (30, 50, or 500) approximately 6 inches, by way of example only. Alternatively, hub mounting members (12) may extend into fan blade (30, 50, or 500) to any suitable length. It will also be appreciated that hub (10) may have mounting members (12) that fit on the outside of fan blades (30, 50, or 500), rather than inside. Alternatively, mounting members (12) may fit both partially inside and partially outside fan blades (30, 50, or 500). In yet another embodiment, a hub interface component (not shown) is provided to eliminate any gaps that may otherwise exist at the interface between a fan blade (30, 50, or 500) and hub (10). Such a hub interface component may be provided as a cuff or sleeve that engages a portion of the end of the fan blade (500). Of course, such an interface component is merely optional.

Fan blade (30, 50, or 500) may also include one or more openings configured to align with openings (22) in hub mounting member (12). In this embodiment, when openings in fan blade (30, 50, or 500) are aligned with openings (22) in hub mounting member (12), fastener (26) may be inserted through the openings to secure fan blade (30, 50, or 500) to hub mounting member (12). In one embodiment, fastener (26) is a bolt. Other suitable alternatives for fastener(s) (26) will be apparent to those of ordinary skill in the art in view of the teachings herein, including but not limited to adhesives. Accordingly, it will be understood that openings (22) are optional.

Fan blade (30, 50, or 500) may be approximately 1, 2, 3, 4, 5, 6, 7, 8, 9, 10, 11, 12, 13, or 14 feet long. Alternatively, fan blade (30, 50, or 500) may be of any other suitable length, including longer than or shorter than the exemplary lengths explicitly stated herein. In one embodiment, fan blade (30, 50, or 500) and hub (10) are sized such that a fan comprising fan blades (30, 50, or 500) and hub (10) has a diameter of approximately 24 feet. In another embodiment, fan blade (30, 50, or 500) and hub (10) are sized such that a fan comprising fan blades (30, 50, or 500) and hub (10) has a diameter of approximately 14 feet. In yet another embodiment, fan blade (30, 50, or 500) and hub (10) are sized such that a fan comprising fan blades (30, 50, or 500) and hub (10) has a diameter of approximately 6 feet. Other suitable dimensions will be apparent to those of ordinary skill in the art in view of the teachings herein.

It will be appreciated that all cross sections along the length of fan blade (30, 50, or 500) need not be identical. In other words, the configuration of fan blade (30, 50, or 500) need not be uniform along the entire length of fan blade (30, 50, or 500). By way of example only, a portion of the "hub mounting end" of fan blade (30, 50, or 500) (i.e. the end of fan blade (30, 50, or 500) that will be mounted to hub (10)) may be removed. In one example, an oblique cut is made to leading edge (56) of fan blade (50) to accommodate another blade (50) on hub (10).

Alternatively, fan blade (30, 50, or 500) may be formed or constructed such that a portion of the hub mounting end or another portion is omitted, relieved, or otherwise "missing." It will be appreciated that the absence of such a portion (regardless of whether it was removed or never there to begin with) may alleviate problems associated with blades (30, 50, or 500) interfering with each other at hub (10). Such interference may be caused by a variety of factors, including but not limited to chord length of fan blades (30, 50, or 500). Of course, factors other than interference may influence the removal or other absence of a portion of fan blade (30, 50, or 500). The absent portion may comprise a portion of leading edge (36 or 56), a portion of trailing edge (38 or 58), or both.

Alternatively, to address fan blade (30, 50, or 500) interference at hub (10), the diameter of hub may be increased (e.g., such as without increasing the number of hub mounting members (12)). Alternatively, the chord of fan blades (30, 50, or 500) may be reduced. Still other alternatives and variations of hub (10) and/or fan blades (30, 50, or 500) will be apparent to those of ordinary skill in the art in view of the teachings herein.

In view of the teachings herein, those of ordinary skill in the art will appreciate that fan blade (30, 50, or 500) may have a zero or non-zero angle of attack. By way of example only, when mounted to hub mounting member (12), fan blade (30, 50, or 500) may have an angle of attack in the range of approximately −1° to 7°, inclusive; between −2° and 10°, inclusive; or approximately 7°, 8°, 10°, or 13° by way of example only. As another merely illustrative example, a fan blade (500) may be mounted at an angle of attack within a range of approximately −8°, inclusive, and approximately 8°, inclusive. Of course, fan blade (30, 50, or 500) may have any other suitable angle of attack. Fan blade (30, 50, or 500) may be substantially straight along its length, and the angle of attack may be provided by having hub mounting member (12) with the desired angle of attack.

Alternatively, the angle of attack of hub mounting member (12) may be zero, and an angle of attack for fan blade (30, 50, or 500) may be provided by a twist in fan blade (30, 50, or 500). In other words, fan blade (30, 50, or 500) may be substantially straight along the length to which hub mounting member (12) extends in fan blade (30, 50, or 500), and a twist may be provided to provide an angle of attack for the remaining portion of fan blade (30, 50, or 500). Such a twist may occur over any suitable length of fan blade (30, 50, or 500) (e.g., the entire remainder of fan blade (30, 50, or 500) length has a twist; or the twist is brief, such that nearly all of the remainder of fan blade (30, 50, or 500) is substantially straight; etc.). Still other suitable configurations and methods for providing an angle of attack for all or part of fan blade (30, 50, or 500) will be apparent to those of ordinary skill in the art in view of the teachings herein. In addition, it will be appreciated that all or any portion of fan blade (30, 50, or 500) may have one or more twists for any purpose.

In view of the teachings herein, those of ordinary skill in the art will appreciate that a fan blade (e.g., 30, 50, or 500) may be modified in a number of ways. Such modifications may alter the characteristics of fan performance. As illustrated in exemplary form in FIGS. 6 through 10, one such modification may include winglet (70). While winglets (70) will be discussed in the context of fan blades (30, 50, and 500), it will be appreciated that winglets (70) may be used with any other suitable fan blades.

Winglet (70) of the present example includes vertical member (72). Vertical member (72) comprises flat inner surface (74) and rounded outer surface (76). Other suitable configurations for inner surface (74) and outer surface (76) will be apparent to those of ordinary skill in the art in view of the teachings herein. In the present example, the perimeter of vertical member (72) is defined by lower edge (78), upper edge (80), and rear edge (82). Each edge (78, 80, and 82) meets generally at respective corner (84). Thus, in the present example, vertical member (72) has three corners (84). As shown, each corner (84) is rounded. Accordingly, the term "corner," as that term is used herein, shall not be read to require a sharp angle. In other words, a corner need not be limited to a point or region at which a pair of straight lines meet or intersect. While in the present example vertical member (72) is described as having three corners, it will be appreciated that vertical member (72) may have any suitable number of corners (84).

Other variations of vertical member (72) will be apparent to those of ordinary skill in the art in view of the teachings herein.

Winglet (70) of the present example further includes winglet mounting member (90), which extends substantially perpendicularly from inner surface (74) of vertical member (72). As shown, winglet mounting member (90) is configured similar to hub mounting member (12). Winglet mounting member (90) has top surface (92) and bottom surface (94), which each terminate into leading edge (96) and trailing edge (98). In addition, each winglet mounting member (92) includes openings (100) formed through top surface (92) and bottom surface (94). In the present example, each opening (100) is sized to receive fastener (26). Winglet mounting member (90) is configured to be inserted into an end of fan blade (30, 50, or 500). In view of the teachings herein, those of ordinary skill in the art will appreciate that winglet mounting members (90) may be provided in a variety of alternative configurations.

Figure 9:
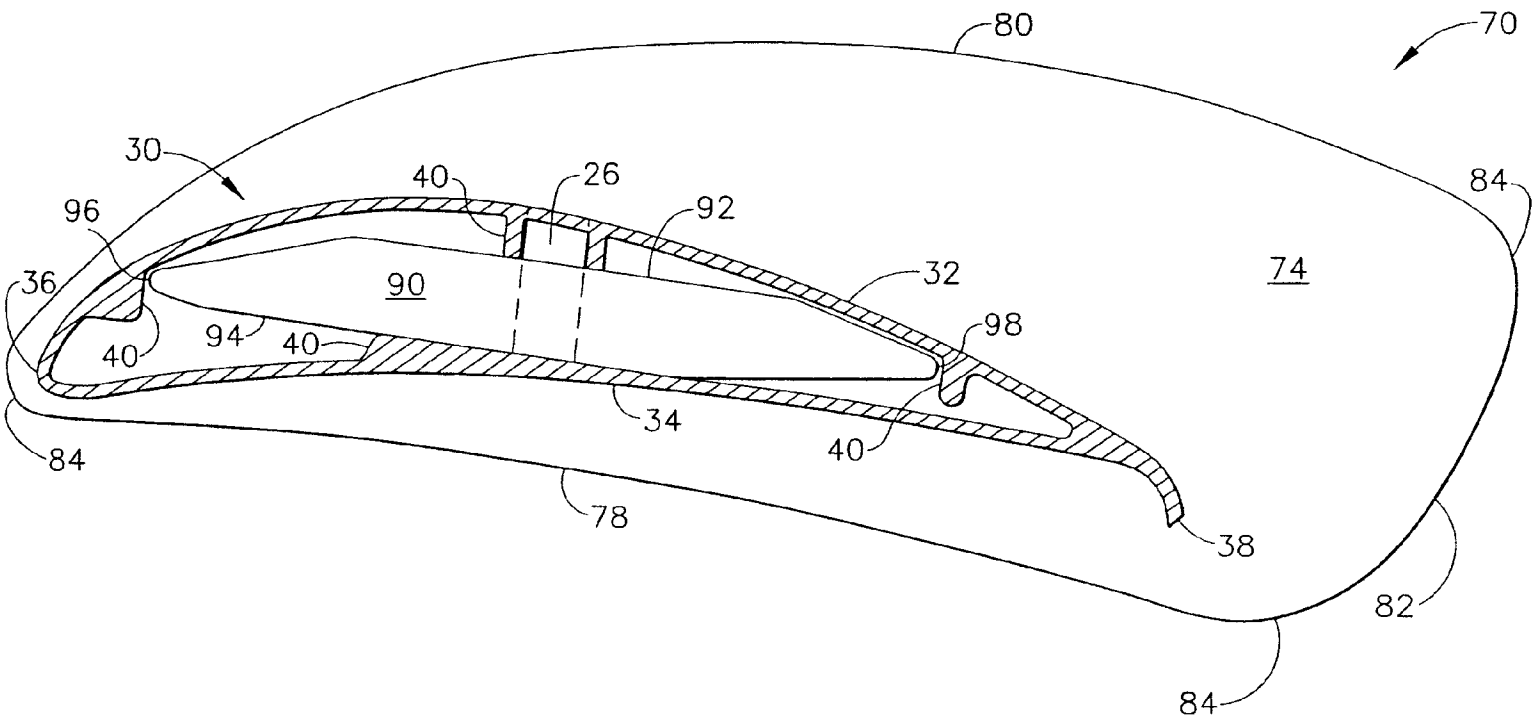
FIG. 9 is an end view of the fan blade of FIG. 2 modified with the winglet of FIG. 6.
Figure 10:
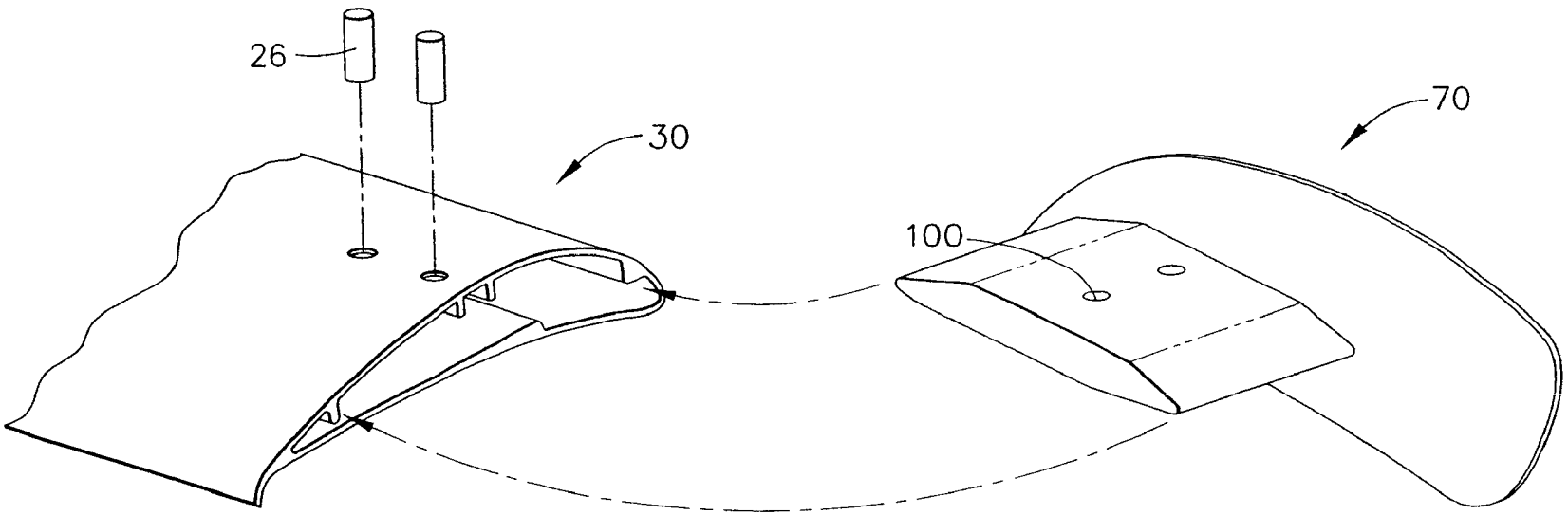
FIG. 10 is an exploded perspective view of the winglet-blade assembly of FIG. 9.

FIG. 9 shows a cross section of fan blade (30) with winglet (70) mounted thereto. The cross section is taken along a transverse plane located at the center of fan blade (30), looking toward winglet (70) (i.e. away from hub (10)). In the present example, and as shown in FIGS. 9 and 10, winglet mounting member (90) is configured to fit in the end of fan blade (30, 50, or 500). Like hub mounting member (12), winglet mounting member (90) fits snugly against bosses (40 or 60) in fan blade (30, 50, or 500). In the present example, upper edge (80) of winglet (70) extends above top surface (32 or 52) of fan blade (30, 50, or 500), in addition to extending beyond leading edge (36 or 56). Similarly, lower edge (78) of winglet (70) extends below bottom surface (34 or 54) of fan blade (30, 50, or 500). Rear edge (82) of winglet (70) extends beyond trailing edge (38 or 58) of fan blade (30, 50, or 500). Of course, winglets (70) and fan blades (30, 50, or 500) may have any other relative sizing and/or configuration.

Fan blade (30, 50, or 500) may have one or more openings, formed near the tip of fan blade (30, 50, or 500) through top surface (32 or 52) and/or bottom surface (34 or 54), which is/are positioned to align with opening(s) (100) in winglet mounting member (90) when winglet mounting member (90) is inserted into fan blade (30, 50, or 500), and which is/are sized to receive fastener (26). Winglets (70) may thus be secured to fan blades (30, 50, or 500) with one or more fasteners (26). In one embodiment, fastener (26) is a bolt. In another embodiment, fastener (26) comprises a complimentary pair of thin head interlocking binding screws, such as screw posts occasionally used to bind a large volume of papers together (e.g., "male" screw with threaded outer surface configured to mate with "female" screw having threaded inner surface). However, any other suitable fastener(s) may be used, including but not limited to adhesives. Accordingly, it will be appreciated that openings (100) are optional.

It will also be appreciated that winglet mounting member (90) need not be inserted into an end of fan blade (30, 50, or 500). In other words, and similar to hub mounting members (12), winglet mounting member (90) may be made to fit on the outside of fan blades (30, 50, or 500), rather than inside. Alternatively, winglet mounting members (90) may fit both partially inside and partially outside fan blades (30, 50, or 500). Furthermore, a winglet (70) may simply be welded to the end of a fan blade (30, 50, or 500), may be otherwise secured relative to a fan blade (30, 50, or 500), or may even be formed integrally with a fan blade (30, 50, or 500). Thus, a mounting member (90) is not required, as one of ordinary skill in the art will readily recognize in view of the teachings herein. Still other configurations will be apparent to those of ordinary skill in the art in view of the teachings herein.

In an alternate embodiment, winglet (70) lacks mounting member (90), and instead has a recess formed in inner surface (74) of vertical member (72). In this embodiment, the tip of fan blade (30, 50, or 500) is inserted into winglet (70) for attachment of winglet (70) to fan blade (30, 50, or 500). In yet another embodiment, fan blade (30, 50, or 500) is integrally formed with winglet (70). Accordingly, and in view of the teachings herein, those of ordinary skill in the art will appreciate that there exists a variety of configurations for providing fan blade (30, 50, or 500) with winglet (70).

While vertical member (72) is shown as being substantially perpendicular to mounting member (90), it will be appreciated that these two members may be at any suitable angle relative to each other. Thus, and by way of example only, vertical member (72) may tilt inward or outward when winglet (70) is attached to fan blade (30, 50, or 500). Alternatively, vertical member (72) may comprise more than one angle. In other words, vertical member (72) may be configured such that the top portion of vertical member and the bottom portion of vertical member each tilt inward when winglet is attached to fan blade (30, 50, or 500). Other variations of winglet (70), including but not limited to angular variations, will be apparent to those of ordinary skill in the art in view of the teachings herein.

While winglet (70) is specifically described herein as a modification to fan blades (30, 50, or 500), it will be appreciated that winglet (70) may be used to modify any other fan blades.

In one embodiment, winglet (70) is formed from homogenous continuum of molded plastic. However, it will be appreciated that winglet (70) may be made from a variety of materials, including but not limited to any suitable metal and/or plastic, and may comprise a plurality of pieces. In addition, it will be appreciated that winglet may be made by any suitable method of manufacture.

It will also be appreciated that trailing vortices that form at or near the tips of fan blades (30, 50, or 500) may increase lift near the tips of fan blades (30, 50, or 500). Winglets (70) may inhibit the radial airflow over top surface (32 or 52) and/or bottom surface (34 or 54) near the tips of fan blades (30, 50, or 500). Such inhibition may force air to flow more normally from leading edge (36 or 56) to trailing edge (38 or 58), thereby enhancing efficiency of a fan having fan blades (30, 50, or 500) with winglets (70), at least at certain rotational speeds.

In one example, winglets (70) are attached to ends of fan blades (30, 50, or 500) on a fan having a 6 foot diameter. With the addition of winglets (70), the air flow rate of the fan is increased by 4.8% at 171 rpm.

In another example, winglets (70) are attached to ends of fan blades (30, 50, or 500) on a fan having a 14 foot diameter. With the addition of winglets (70), the air flow rate of the fan is increased by 4.4% at 75 rpm.

The following two tables illustrate efficiencies that may be obtained by adding winglets (70) to a fan having a 14 foot diameter:

TABLE 3

| Fan Without Winglets (70) | | | | | |
|---|---|---|---|---|---|
| Speed (rpm) | Max. Power (watt) | Avg. Power (watt) | Torque (in · lbs) | Flowrate (cfm) | Efficiency (cfm/watt) |
| 12.5 | 54 | 50 | 17.86 | 0 | 0 |
| 25 | 66 | 54 | 78.80 | 34,169 | 632.76 |
| 37.5 | 125 | 82 | 187.53 | 62,421 | 761.23 |
| 50 | 339 | 263 | 376.59 | 96,816 | 368.12 |
| 62.5 | 700 | 660 | 564.01 | 110,784 | 167.85 |
| 75 | 1170 | 1140 | 839.75 | 129,983 | 114.02 |

TABLE 4

| Fan With Winglets (70) | | | | | |
|---|---|---|---|---|---|
| Speed (rpm) | Max. Power (watt) | Avg. Power (watt) | Torque (in · lbs) | Flowrate (cfm) | Efficiency (cfm/watt) |
| 12.5 | 50 | 42 | 18.56 | 26,815 | 638.45 |
| 25 | 58 | 43 | 18.39 | 46,547 | 1,082.49 |
| 37.5 | 68 | 49 | 186.00 | 61,661 | 1,258.39 |
| 50 | 241 | 198 | 354.61 | 87,552 | 442.18 |
| 62.5 | 591 | 528 | 582.78 | 120,859 | 228.90 |
| 75 | 980 | 950 | 847.41 | 136,560 | 143.75 |

Of course, other values may be realized through use of winglets (70). In addition, suitable variations of winglets, including but not limited to alternative winglet configurations, will be apparent to those of ordinary skill in the art in view of the teachings herein.

In summary, numerous benefits have been described which result from employing the concepts of the invention. The foregoing description of one or more embodiments of the invention has been presented for purposes of illustration and description. It is not intended to be exhaustive or to limit the invention to the precise form disclosed. Obvious modifications or variations are possible in light of the above teachings. The one or more embodiments were chosen and described in order to best illustrate the principles of the invention and its practical application to thereby enable one of ordinary skill in the art to best utilize the invention in various embodiments and with various modifications as are suited to the particular use contemplated. It is intended that the scope of the invention be defined by the claims appended hereto.

What is claimed is:

1. A fan blade configured to mount to a rotating fan hub, the fan blade comprising:

(a) a top surface having a portion generally elliptical curvature, wherein at least a portion of the curvature of the top surface is based on a first ellipse;

(b) a bottom surface having a concave region;

(c) a leading edge, wherein the top surface and bottom surface each terminate at the leading edge;

(d) a trailing edge, wherein the top surface and bottom surface each terminate at the trailing edge; and (e) a trailing edge flap region defined by the top surface and bottom surface and located proximate to the trailing edge, wherein at least a portion of the trailing edge flap region forms the concave region, wherein the angle is at least 20°.

2. The fan blade of claim 1, wherein the fan blade is substantially hollow.

3. The fan blade of claim 2, wherein the fan blade has an interior including one or more bosses configured to engage a fan hub mounting member.

4. The fan blade of claim 1, wherein the fan blade is formed of extruded material.

5. The fan blade of claim 4, wherein the extruded material comprises aluminum.

6. The fan blade of claim 1, wherein the first ellipse is generated based at least in part on the following equations:

$$x=a(\mathrm{COS}(t)), \text{ and} \quad [1]$$

$$y=b(\mathrm{SIN}(t)), \quad [2]$$

wherein x and y provide an x-y plot of the first ellipse,
wherein a=length of a primary radius,
wherein b=length of a secondary radius, and
wherein t=angle of rotation of a radius about an origin.

7. The fan blade of claim 1, wherein a first portion of the concave region has a generally elliptical curvature.

8. The fan blade of claim 7, wherein the generally elliptical curvature of the concave region is based on the first ellipse.

9. The fan blade of claim 7, wherein the first portion of the concave region is generally parallel with a corresponding portion of the top surface.

10. The fan blade of claim 1, wherein the bottom surface further comprises a convex region.

11. The fan blade of claim 10, wherein the convex region is defined by a substantially constant radius of curvature.

12. The fan blade of claim 11, wherein the substantially constant radius of curvature is between approximately 2 inches, inclusive, and approximately 20 inches, inclusive.

13. The fan blade of claim 10, wherein the bottom surface further comprises a transition region providing a transition between the convex region and the concave region.

14. The fan blade of claim 13, wherein the transition region is defined by a radius of curvature.

15. The fan blade of claim 14, wherein the radius of curvature is between approximately 0.25 inches, inclusive, and approximately 5.0 inches, inclusive.

16. The fan blade of claim 1, wherein the trailing edge flap region includes a first flap portion and a second flap portion.

17. The fan blade of claim 16, wherein the first flap portion is bent inward, toward the leading edge, relative to an adjacent portion of the bottom surface; wherein the second flap portion is bent further inward, further toward the leading edge, relative to the first flap portion.

18. A fan blade configured to mount to a rotating fan hub, the fan blade comprising:

(a) a top surface comprising:

i. a first portion with a curvature defined by a portion of an ellipse that is generated based on the following equations:

$$x=a(\mathrm{COS}(t)), \text{ and} \quad [1]$$

$$y=b(\mathrm{SIN}(t)), \quad [2]$$

wherein x and y provide an x-y plot of the ellipse, wherein a=length of a primary radius, wherein b=length of a secondary radius, and wherein t=angle of rotation of a radius about an origin, and ii, a second portion having a starting point located distal of the first portion;

(b) a bottom surface having a concave region, a convex region, and a transition region;

(c) a leading edge, wherein the top surface and bottom surface meet at the leading edge; and (d) a trailing edge, wherein the top surface and bottom surface meet at the trailing edge;

wherein the location of the starting point of the second portion of the top surface is distal of the transition region of the bottom surface.

19. A fan blade configured to mount to a rotating fan hub, the fan blade comprising:

(a) a top surface having a portion generally elliptical curvature, wherein the generally elliptical curvature of the portion of the top surface is based on a first ellipse;

(b) a bottom surface having a concave region and a convex region, with a transition region between the concave region and the convex region, wherein the convex region has a curvature defined by a substantially constant radius;

(c) a leading edge, wherein the top surface and bottom surface each terminate at the leading edge;

(d) a trailing edge, wherein the top surface and bottom surface each terminate at the trailing edge;

(e) a substantially hollow section defined by the convex region and a first portion of the top surface; and (f) a substantially solid, curved airfoil section defined by the concave region and a second portion of the top surface.

* * * * *

UNITED STATES PATENT AND TRADEMARK OFFICE

CERTIFICATE OF CORRECTION

PATENT NO. : 8,079,823 B2
APPLICATION NO. : 11/858360
DATED : December 20, 2011
INVENTOR(S) : Aynsley It is certified that error appears in the above-identified patent and that said Letters Patent is hereby corrected as shown below:

Column 16, Claim 1, line 36, reads "...a portion generally elliptical..."; which should be deleted and replaced with "...a portion with a generally elliptical...."

Column 16, Claim 1, line 47, reads "...forms the concave region..."; which should be deleted and replaced with "...forms an angle with the concave region...."

Column 17, Claim 15, lines 20 and 21, reads "...of curvature is between..."; which should be deleted and replaced with "...of curvature of the transition region is between...."

Column 18, Claim 19, line 19, reads "...a portion generally elliptical..."; which should be deleted and replaced with "...a portion with a generally elliptical...."

Signed and Sealed this
Seventh Day of February, 2012

David J. Kappos

David J. Kappos
*Director of the United States Patent and Trademark Office*